US010227077B2

(12) United States Patent
Skowronek

(10) Patent No.: US 10,227,077 B2
(45) Date of Patent: Mar. 12, 2019

(54) SYSTEM OF A BEARING BRACKET AND A COUPLER ROD OR CONNECTION ROD, A MULTI-CAR VEHICLE AND A METHOD FOR CONTROLLING THE MOVEMENT OF A COUPLER ROD OR CONNECTION ROD

(71) Applicant: Dellner Couplers AB, Falun (SE)

(72) Inventor: Jacek Skowronek, Gdynia (PL)

(73) Assignee: Dellner Couplers AB, Falun (SE)

( * ) Notice: Subject to any disclaimer, the term of this patent is extended or adjusted under 35 U.S.C. 154(b) by 187 days.

(21) Appl. No.: 15/125,015

(22) PCT Filed: Mar. 9, 2015

(86) PCT No.: PCT/EP2015/000522
§ 371 (c)(1),
(2) Date: Sep. 9, 2016

(87) PCT Pub. No.: WO2015/135642
PCT Pub. Date: Sep. 17, 2015

(65) Prior Publication Data

US 2017/0021844 A1 Jan. 26, 2017

(30) Foreign Application Priority Data

Mar. 10, 2014 (EP) ..... 14000833

(51) Int. Cl.
*B61G 7/14* (2006.01)
*B61G 7/12* (2006.01)
(Continued)

(52) U.S. Cl.
CPC ..... *B61G 7/14* (2013.01); *B61G 1/40* (2013.01); *B61G 7/12* (2013.01); *B61G 11/16* (2013.01)

(58) Field of Classification Search
CPC ... B61G 1/00; B61G 1/02; B61G 1/10; B61G 1/18; B61G 1/20; B61G 1/28; B61G 1/40
See application file for complete search history.

(56) References Cited

U.S. PATENT DOCUMENTS 7,552,830 B2 6/2009 Radewagen
8,328,030 B2 12/2012 Kontetzki
(Continued)

FOREIGN PATENT DOCUMENTS

AU 2004281875 C1 4/2014
CN 1852823 A 10/2006
(Continued)

OTHER PUBLICATIONS

International Search Report dated Jun. 18, 2015 for related PCT Application No. PCT/EP2015/000522.

*Primary Examiner* — Robert J McCarry, Jr.
(74) *Attorney, Agent, or Firm* — Howard IP Law Group

(57) ABSTRACT

A system includes a bearing bracket, for connecting a coupler rod or a connection rod to a car, and a coupler rod or a connection rod connected to the bearing bracket. The bearing bracket has an adapter and a joint that allows the adapter to swivel relative to the bracket. The rod has a stabilizing element having a surface that is not parallel to the longitudinal axis of the rod and is spaced apart from a surface of the bearing bracket. Upon application of a force of a predetermined first strength in one direction, the adapter moves relative to the bracket in the one direction until the surface of the stabilizing element contacts the surface of the bearing bracket. Upon application of a force of a second strength to the rod, the stabilizing element detaches from the rod, so that the rod can move relative to the stabilizing element.

17 Claims, 2 Drawing Sheets

(51) Int. Cl.
*B61G 11/16* (2006.01)
*B61G 1/40* (2006.01)

(56) References Cited

U.S. PATENT DOCUMENTS

| | | | |
|---|---|---|---|
| 8,540,093 | B2 | 9/2013 | Paral |
| 2008/0277366 | A1 | 11/2008 | Kemper |

FOREIGN PATENT DOCUMENTS

| | | | | | |
|---|---|---|---|---|---|
| CN | 101870296 | A | | 10/2010 | |
| CN | 102164801 | A | | 8/2011 | |
| DE | 19636225 | A1 | | 3/1998 | |
| EP | 1312527 | A1 | | 5/2003 | |
| EP | 1719684 | A1 | | 11/2006 | |
| EP | 1925523 | | * | 5/2008 | ..... B61G 5/02 |
| EP | 1925523 | A1 | | 5/2008 | |
| EP | 1955918 | A1 | | 8/2008 | |
| JP | 2008254542 | A | | 10/2008 | |
| JP | 2008254543 | A | | 10/2008 | |
| WO | 2005032906 | A1 | | 4/2005 | |
| WO | 2012111300 | A1 | | 8/2012 | |

* cited by examiner

SYSTEM OF A BEARING BRACKET AND A COUPLER ROD OR CONNECTION ROD, A MULTI-CAR VEHICLE AND A METHOD FOR CONTROLLING THE MOVEMENT OF A COUPLER ROD OR CONNECTION ROD

CROSS-REFERENCE TO RELATED APPLICATIONS

This application is a national phase application under 35 U.S.C. § 371 of International Patent Application No. PCT/EP2015/000522 filed Mar. 9, 2015, which claims priority to European Application No. 14000833.5 filed Mar. 10, 2014, all of which are incorporated herein by reference in their entirety for all purposes.

FIELD OF INVENTION

The invention relates to a system of a bearing bracket and a coupler rod or connection rod, a multi-car vehicle and a method for controlling the movement of a coupler rod or connection rod.

BACKGROUND

Multi-car vehicles are known in different designs and in different forms of adaptation for uses. Multi-car vehicles, for example, railway-bound trains (streetcars and subway-trains also being considered as such trains) are known and are known for the purpose of transporting passengers as well as transporting goods. Further types of multi-car vehicles can be magnetic railway-trains or can be busses (road busses as well as busses traveling on fixed tracks). A car of a multi-car vehicle can be a self-supporting car, whereby the car has sufficient wheels that are placed at sufficient locations such that the car can stand by itself without being supported by other cars, for example, a three-wheeled car, a four-wheeled car or a car with even more wheels placed at suitable locations. A car of a multi-car vehicle can also be of the non-self-supporting type, whereby the car has no wheels or only wheels provided in such number or arranged at such a place that the car cannot stand by itself, but is vertically supported by at least one neighboring car.

To form the multi-car vehicles, the individual cars of the vehicle are connected to one another by means of a connecting device. The connecting device can be provided for different types of purposes. In multi-car vehicles where only one or only several of the total of cars is driven, the connecting devices are provided so that the driven car can drive the non-driven car and thus ensures that the complete vehicle travels with the same speed. Connecting devices are also distinguished between those connecting devices that allow for an easy decoupling of the cars, whereby easy decoupling is understood to be accomplished within a couple of minutes, or for what is called "semi-permanent" coupling of cars, for which decoupling of the cars takes efforts and usually involves the vehicle to have been transported to a specific workshop. Trains, for example, can have coupler-heads as a part of their connecting devices. These coupler-heads can, for example, be so-called "automatic couplers" that allow decoupling within minutes.

From EP 1 719 684 a bearing bracket (called "Lagerbock" in EP 1 719 684 B1) of a central buffer coupling is known that is suitable to connect a coupler rod ("Kupplungsschaft" in EP 1 719 684 B1) to a car. The coupler rod is arranged to pass through a housing and is connecting to said housing by elastic members arranged at the outside of the coupling rod and held inside the housing. The housing is connected to a bracket by means of a top-pivot pin and a bottom-pivot pin that allow the housing to swivel relative to the bracket about a vertical swivel axis. Arranged between the housing and the top-swivel pin and the bottom-swivel pin are shear-off elements. If the coupling rod is pushed along its longitudinal axis with a pushing force of a predetermined magnitude, the shear-off elements will set the housing free with respect to the bracket and will allow the coupling rod and the housing to move relative to the bracket in unison. The design known from EP 1 719 684 B1 is disadvantageous, because it does not allow for any stabilizing effect in case of a coupler rod misaligned from the horizontal.

Form EP 1 312 527 B1 an articulated arrangement for a multi-car vehicle is known that comprises a first articulated arm and a second articulated arm, which cooperate in an articulated manner by means of a bearing. An energy dissipating member is integrated into one of the articulated arms. This articulation is achieved by giving the respective joint arm a basic body with horizontal and vertical flanges arranged at this basic body. A profile 9 that forms part of the joint arm is arranged to glide along guides arranged inside the basic body. Also arranged inside the basic body is a deformation tube that is held at one end by a pressure plate that closes the hollow space inside the basic body, in which the deformation tube and the profile are arranged. The deformation tube on its other side is held by the profile. The basic body, the pressure plate, the deformation tube and the profile jointly form the articulated arm. The unit of pieces that is thus created is connected to the car as one unit and held to the car by means of the flanges of the basic body. The design known from EP 1 312 527 B1 is disadvantageous because the basic body has a substantial longitudinal extent, the main portion of which is arranged below the car. This makes it necessary for the car builder to provide room in this area of the car, which takes up the basic body and the elements of the articulated arm arranged inside the basic body.

From EP 1 925 523 B1 a bearing bracket is known that has a vertically extending swivel pin arranged to pass through an eye arranged in a coupling rod and thereby forming a spherical bearing. The eye in the coupling rod is larger than the diameter of the swivel pin. The space created is filled with an elastic material that allows the coupling rod to move in a longitudinal direction relative to the swivel pin. The use of the elastic material pretensions the coupling rod into a predetermined, normal position relative to the swivel pin. The bracket is provided with vertical contact faces, one above the horizontal plane that contains the center line of the coupling rod, one below the horizontal plane that contains the center line of the coupling rod. The coupling rod also is provided with vertical contact surfaces, one surface above the horizontal plane that contains the center line of the coupling rod and one surface arranged below the horizontal plane that contains the center line of the coupling rod. In the normal state and defined by the elastic properties of the material arranged in the eye in the coupling rod, the contact surfaces of the bracket and the coupling rod are arranged to face each other but are distanced apart. If the coupling rod is moved by a predetermined force that overcomes the resilience of the elastic material arranged in the eye, the coupling rod is pushed towards the bracket in such a manner that the contact surfaces of the bracket come into contact with the contact surfaces of the coupling rod. This arrangement limits the distance that the coupling rod can move relative to the bracket. Also the use of contact surfaces above and below the horizontal plane that contains the center line of the coupling rod provides a stabilizing function that returns the coupling rod into a horizontal alignment in cases, where the coupling rod at the time of being pushed towards the bracket is not arranged in a horizontal alignment. In such a case, the contact surface of the coupling rod arranged on the one side of the horizontal plane that contains the center line will contact its counterpart contact surface of the bracket earlier. Continuous application of a force along the longitudinal axis of the coupling rod will then lead to a return-moment that will return the coupling rod into the horizontal alignment. The design known from EP 1 925 523 B1 is disadvantageous, because it does not allow for energy-dissipating elements to be arranged as part of the bearing bracket.

SUMMARY

Based on this background the problem to be solved by the invention is to suggest a system of a bearing bracket suitable to connect a coupler rod or a connection rod to a car and a coupler rod or a connection rod connected to the bearing bracket as well as multi-car vehicle and a method that allows for a multi-stage energy absorption concept.

This problem is solved by the system, the multi-car vehicle and the method described in the description following hereafter.

The basic idea of the bearing bracket according to the invention is to provide the coupler rod or connection rod with a surface that in a crash scenario can interact with a surface of the bearing bracket to provide a flow of force directly from the coupler rod or connection rod into the bearing bracket, but to additionally allow for means to disconnect this flow of force directly from the coupler rod or connection rod into the bearing bracket, if a predetermined force level is reached. This is achieved by providing the surface that extends in a direction that is not parallel to the longitudinal axis of the coupler rod or connection rod on a stabilizing element attached to the further parts of the coupler rod or connection rod, for example the outer circumference of a cylindrical section of the coupler rod or connection rod, and to allow the further parts of the coupler rod or connection rod to move relative to the stabilizing element, if a pushing force of a predetermined second strength is applied to the coupling rod or connection rod that points along the longitudinal axis of the coupling rod or connection rod in the operating condition where the surface of the coupler rod or connection rod is in contact with the surface of the bearing bracket.

In normal operating conditions, the pushing force that acts along the coupling rod or connection rod, for example, if the multi-car vehicle slows down, will be transmitted from the coupling rod or connection rod via the joint into the bracket and into the car. This force can be dampened by damping elements provided as part of the coupling rod or connection rod, for example by means of a gashydraulic cylinder integrated into the connection rod or coupling rod or provided as part of the bearing bracket, for example by means of a sphaerolastic element around a joint pin of the joint.

In a crash scenario, where a pushing force of a predetermined first strength acts along the coupling rod or connection rod, the coupling rod or connection rod is set free to move relative to the bracket. In a preferred embodiment, the coupler rod or connection rod has a front end and an energy absorbing element is arranged in contact with the front end. In such an embodiment, the pushing force of a predetermined first strength can be the pushing force necessary to start the energy absorption of the energy absorbing element, for example to start the destruction of a honeycomb element or start the deformation of a deformation tube. In an alternative embodiment an energy absorbing element is spaced apart from the front end the energy absorbing element and the coupling rod or connection rod is held in this position by shear off elements, for example shear off bolts or shear off pins. In this embodiment, the pushing force of a predetermined first strength can be the pushing force that is necessary to shear off the shear off element and set the coupling rod or connection rod free.

The distance that the coupler rod or connection rod is free to travel is determined by the distance that the one surface that extends in a direction that is not parallel to the longitudinal axis of the coupler rod or connection rod is arranged spaced apart from a surface of the bearing bracket. This distance can for example be chosen on the basis of the length along which an energy absorbing element absorbs energy, for example the length of a honeycomb element or the length of a deformation tube. After the coupler rod or connection rod has travelled this distance and closed the gap, the contact between the one surface that extends in a direction that is not parallel to the longitudinal axis of the coupler rod or connection rod the surface of the bearing bracket leads to a flow of force from the coupler rod or connection rod directly to the bearing bracket. Thereby the joint can be protected.

In a crash scenario, where a pushing force of a predetermined second strength acts along the coupling rod or connection rod that is higher than the pushing force of the predetermined first strength, the above described actions will take place, but also the further parts of the coupler rod or connection rod will start to move relative to the stabilizing element and will thereby disconnect the flow of force directly from the coupler rod or connection rod into the bearing bracket. This allows for other crash absorbers to be activated, if they are present in a preferred embodiment of the invention.

The bearing bracket according to the invention has an adapter that is adapted such that the coupler rod or the connection rod can be connected to it or that is formed as part of the connection rod or coupler rod. The bearing bracket also has a bracket suitable for being connected to the car and has a joint that is arranged in such a manner that it allows the adapter to swivel relative to the bearing bracket about at least one swivel axis.

In a preferred embodiment, the joint has a least one joint pin that is partially held in a receptacle of the joint receiving part. FIGS. 3 to 7 of EP 1 925 523 B1 show such a joint that has a vertical joint pin that is received into the receptacles. One receptacle is provided as a hole in an upper part of the bearing bracket. One further receptacle is provided as a hole in the lower part of the bearing bracket of EP 1 925 523 B1. The joint for the bearing bracket according to the invention can in a preferred embodiment also be of the type shown in FIGS. 1 and 2 of EP 1 925 523 B1, whereby the joint has a top joint pin and a (separate) bottom joint pin. The top joint pin being received by a hole in the top part of the bearing bracket, the (separate) bottom joint pin being held by a hole in a bottom part of the bearing bracket of EP 1 925 523 B1. In a preferred embodiment the at least one joint pin is arranged to extend in the vertical direction.

In a preferred embodiment, the receptacle that holds the joint pin is provided by at least two parts of the joint receiving part, each of the at least two parts forming a part of the wall that delimits the receptacle, whereby the two parts are connected to each other by a connection that upon application of a force of a predetermined strength can shear off. This connection can, for example, be provided by shear-off bolts. Also, it is feasible that the two parts are welded together or are glued together and are torn apart upon application of the predetermined force. Also it is feasible for the two parts of the joint receiving part to be provided by one element that has a predetermined breaking point or a predetermined breaking line provided by a weakness in the material or provided by the material at this point/line being very thin.

In a preferred embodiment, the two parts are connected to each other by means of shear-off bolts that are arranged around the longitudinal axis of the coupling rod or connection rod. Preferably, the two parts are connected by two shear-off bolts that are arranged in the same horizontal plane. In a preferred embodiment, the joint pin is received in a receptacle of an upper joint receiving part and by a receptacle of a lower joint receiving part. In this embodiment, both joint receiving parts are provided by at least two parts as described above, each of the two receptacles having two shear-off bolts, the two shear-off bolts per joint receiving part connecting the respective two parts of the joint receiving part together. This total of four shear-off bolts provided in this preferred embodiment is preferably arranged at the same distance to the vertical plane that contains the longitudinal axis. Additionally or as an alternative, all four bolts are being arranged at the same distance to the horizontal plane that contains the longitudinal axis. Such a design allows for a symmetric arrangement of the shear-off bolts, which favors the shearing out of the shear-off bolts to take place at the same time, especially in a situation where the coupler rod or the connection rod is in horizontal alignment.

In a preferred embodiment, one of the two parts of the joint receiving part for at least a part of its extent has the shape of a horseshoe. Using the shape of a horseshoe allows for this part of the joint receiving part to partially encompass the joint pin.

In a preferred embodiment, a damping element is arranged such as to dampen the transmission of impacts from the adapter to the bracket. The adapter can, for example, have an eye that receives the joint pin similar to the arrangement of EP 1 925 523 B1, FIGS. 3 to 7, where a joint pin is received in an eye of the coupling rod. In such an arrangement, elastic material can be provided inside the eye that dampens impact forces that are transmitted from the adapter to the joint pin (and thus to the bracket). Providing such damping elements can reduce small impacts from being introduced into the bracket and thus into the car to which the bracket is connected. Such an arrangement can thus reduce the rattle that is introduced into a car.

In a preferred embodiment, the receptacle is provided by at least two parts of a joint receiving part that after a shear-off having taken place can move relative to each other and whereby the one of the two parts guides the movement of the other of the two parts such that the other of the two parts moves in a linear movement relative to the guiding part of the two parts. Such an arrangement ensures that the movement of elements within the bearing bracket according to the invention is controlled to take place in a specific direction after the first shear-off has taken place.

The system according to the invention can be used with several types of connections that connect a first car of a multi-car vehicle to a second car of a multi-car vehicle. The coupler rod or connection rod used as part of the assembly according to the invention is thus adapted to the specific use of the assembly. As described above in the introduction, multi-car vehicles are formed by connecting individual cars of the vehicle to one another by means of a connection device. Such a connection device can have a coupler head as part of the connection device, which allows easy decoupling. If the system according to the invention is to be used in conjunction with such a connection, the assembly will have a coupler rod attached to the adapter. For a "semi-permanent" coupling of the cars, the system of the invention can have a connection rod attached to the adapter. In a different embodiment, where the cars of the multi-car vehicles do not need to be detached easily, the connection device that connects the cars can simply be one connection rod that is attached at one end to one car using the bearing bracket according to the invention and is attached at the other end to a second car, preferably also using the bearing bracket according to the invention at this end.

To facilitate the discussion, reference will be made below to "the rod" which is to be understood as reference to the coupler rod and the connection rod, depending on which of the two is used in the specific design of the system.

The rod in a preferred embodiment has a cross section perpendicular to the longitudinal axis of the rod that has the shape of a circle, the shape of a ring (if the rod is of at least partially hollow design), the shape of an ellipse or the shape of an elliptical ring (if the rod is to be designed at least partially hollow). The shape of the cross section of the rod can change along its longitudinal extent. Energy-consuming elements can be integrated into the rod. For example, the rod can have a hydraulic cylinder that dampens forces acting along its longitudinal axis integrated into the rod at a position along the longitudinal extent of the rod. Also, energy-dissipating element, like honeycomb elements or deformation tubes can be integrated into the rod to dissipate energy, if forces above a predetermined threshold value act along the longitudinal axis of the rod. Also rubber elements, for example rubber elements of donut-shape can be integrated into the rod to take up energy. Likewise hydraulic cylinders can be introduced into the rod as damping elements.

In a preferred embodiment, the adapter can be the end section of the rod. In this embodiment, the rod can have an end section that has the same diameter as the remaining majority of sections of the rod. In a preferred embodiment, however, a rod with an end section that is used as an adapter has an end section with a reduced thickness in one direction. For example EP 1 925 523 B1 shows a coupler rod (Kupplungsstange 20) with an end section (Endabschnitt 21) that has a reduced thickness in the vertical direction.

In an alternative embodiment, the adapter is formed as a separate piece to the rod. The adapter can, for example, have an end plate, for example a vertically extending plate. The rod to be connected to the adapter can also have an end plate that can be connected to the end plate of the rod, for example by means of screws.

In a preferred embodiment, the rod has at least one surface that extends at an angle relative to the longitudinal axis of the rod (which means a surface that extends in a direction (extends in a plane) that is not parallel to the longitudinal axis of the rod) and that is arranged spaced apart from a surface of the bearing bracket and whereby once the adapter is set free to move relative to at least some parts of the bracket in at least one direction, if a pushing force of a predetermined first strength is applied to the adapter that points into this direction, the surface of the rod that extends at an angle to the longitudinal axis moves in this direction to come into contact with the surface of the bearing bracket. The interaction of the two surfaces can provide a stabilizing function. If the rod is misaligned from a predetermined horizontal orientation in a crash scenario, the contact of the surfaces can lead to a rectifying momentum that brings the rod back into a predetermined horizontal alignment.

In a preferred embodiment, the surface of the rod is arranged spaced apart from a surface of the joint receiving part and interacts with this surface of the joint receiving part, once the adapter is set free to move relative to the joint receiving part in the above described condition. Making a stabilizing contact between a surface on the rod and the joint receiving part will provide a good stabilizing function, especially if the joint receiving part is designed of a certain strength.

In a preferred embodiment, the surface that extends at an angle relative to the longitudinal axis of the rod extends into the vertical direction and/or the horizontal direction, whereby the surface of the bearing bracket, preferably the surface of the joint receiving part that will interact with the surface of the rod extends into the vertical direction and/or the horizontal direction (lies in a vertical plane or lies in a horizontal plane). The interaction between surfaces that extend in the vertical direction away from the longitudinal axis of the rod will allow to create a momentum that returns a rod into a predetermined horizontal position, even if during the collision the rod does not extend along a horizontal plane, but at an angle to a horizontal plane. Surfaces that interact with each other and extend in a horizontal direction away from the longitudinal axis of the rod allow a rod to be returned in a predetermined horizontal position, if during a collision, the rod is within the predetermined horizontal plane, but extends at an angle to the desired, predetermined direction along which the longitudinal axis of the rod should extend. It is preferred, for example, that in an arrangement, where the assembly according to the invention is arranged as part of a train that the rod extends in a horizontal plane and extends in the horizontal direction that points along the longitudinal axis of the complete train. The use of vertically extending and horizontally extending surfaces as described above allow for the rod to be returned into this preferred position, if the rod is not in this position during a collision. The assembly according to the invention is thus in a position to achieve the same advantages as the design known from EP 1 925 523 B1.

In a preferred embodiment, the rod has a cylindrical or elliptical outer shape in the region where the surface extends at an angle relative to the longitudinal axis of the rod and the surface that extends at an angle relative to the longitudinal axis of the rod is provided by an element attached to the rod, which element has a cross section that is substantially shaped like a triangle. This design, wherein the surface is provided by an element (the stabilizing element) attached to the rod that "like an ear" extends from the cylindrical or elliptical basic body of the rod provides a design that can be put into practice easily without changing the basic design of a coupler rod or a connection rod. In a preferred embodiment, four such elements that provide the surface are provided, one element in each quadrant. The triangle-shaped cross section of the elements that provide the surfaces can be arranged such that with the side surfaces of the elements joining each other an element with the circumference of a rectangle is formed.

In a preferred embodiment, the surface that extends at an angle relative to an longitudinal axis of the coupler rod or connection rod is arranged above or below the horizontal plane that contains the longitudinal axis of the coupler rod or connection rod and/or left or right of the vertical plane that contains the longitudinal axis of the coupler rod or connection rod. The surface should be placed at a position relative to the longitudinal axis of the rod, where it will be necessary to act against the misalignment of the rod that is to be expected to take place most likely. If it is, for example, expected that the rod in a collision situation has a position, wherein the end of the rod distanced from the assembly is higher than the end of the rod that is connected to the adapter of the assembly, the surfaces should be arranged above the longitudinal axis of the coupler rod. The arrangement of the surfaces above the horizontal plane that contains the longitudinal axis will lead to a momentum that moves a misaligned rod that is in such a position back into the horizontal plane. In a preferred embodiment, the surfaces are provided above and below the horizontal plane that contains the longitudinal axis of the rod and right and left to the vertical plane that contains the longitudinal axis of the rod. The "longitudinal axis of the rod" in the discussion of this preferred embodiment refers to the position that the longitudinal axis of the rod takes in the predetermined, preferred position of the rod, for example the normal driving state of the rod.

In a preferred embodiment the coupler rod or connection rod contains four surfaces that are arranged in the same plane, whereby in each of the quadrants delimited by the horizontal plane that contains the longitudinal axis of the coupler rod or connection rod and the vertical plane that contains the longitudinal axis of the coupler rod or connection rod, one of the four surfaces is arranged.

In a preferred embodiment the pushing force of the predetermined second strength is higher than the pushing force of the predetermined first strength. Preferably, the pushing force of the predetermined second strength is at least 10% higher than the pushing force of the predetermined first strength, more preferably at least 15% higher and even more preferably more than 20% higher than the pushing force of the predetermined first strength. Preferably, the pushing force of the predetermined second strength is not more than 70% higher than the pushing force of the predetermined first strength, more preferably not more than 50% higher and even more preferably more than 40% higher than the pushing force of the predetermined first strength.

In a preferred embodiment, for a light rail vehicle (LRV), the pushing force of the predetermined first strength can be of the magnitude of 400 kN, while the pushing force of the predetermined second strength can be of the magnitude of 550 kN. In a preferred embodiment, for a metro train, the pushing force of the predetermined first strength can be of the magnitude of 800 kN, while the pushing force of the predetermined second strength can be of the magnitude of 1200 kN. In a preferred embodiment, for a regional or a high speed train, the pushing force of the predetermined first strength can be of the magnitude of 1500 kN, while the pushing force of the predetermined second strength can be of the magnitude of 1850 kN.

In a preferred embodiment the stabilizing element is connected to a further part of the coupler rod or connection rod by way of shear off bolts, shear off pins or a frictional connection. In an alternative embodiment the stabilizing element is welded or glued to a further part of the coupler or connection rod or is made as one piece with a further element of the coupler or connection rod, but with a material weakness that lets the stabilizing element break away from the further part of the coupler or connection rod, if the pushing force of the predetermined second strength is applied to the coupling rod or connection rod that points along the longitudinal axis of the coupling rod or connection rod in the operating condition where the surface of the coupler rod or connection rod is in contact with the surface of the bearing bracket.

In a preferred embodiment the joint has at least one joint pin that is received in a receptacle of a joint receiving part, whereby the adapter is set free to move relative to the joint pin, if a pushing force of a predetermined first strength is applied to the adapter that points into this at least one direction, and/or the joint pin is set free to move relative to the joint receiving part, if a pushing force of a predetermined first strength is applied to the adapter that points into this at least one direction, and/or the joint receiving part is set free to move relative to the bracket, if a pushing force of a predetermined first strength is applied to the adapter that points into this at least one direction.

The method according to the invention makes use of the system of the invention. According to this method for controlling the movement of a coupler rod or a connection rod of a system of a bearing bracket suitable to connect a coupler rod or a connection rod to a car and a coupler rod or a connection rod connected to the bearing bracket, whereby the bearing bracket the adapter is set free to move relative to at least some parts of the bracket in at least one direction by applying a pushing force of a predetermined first strength that points into this at least one direction, whereby once the adapter is set free to move relative to the bracket in the one direction, the surface of the coupler rod or connection rod moves in this direction and comes into contact with the surface of the bearing bracket, and whereby the application of a pushing force of a predetermined second strength to the coupling rod or connection rod that points along the longitudinal axis of the coupling rod or connection rod makes the further parts of the coupler rod or connection rod move relative to the stabilizing element.

BRIEF DESCRIPTION OF THE DRAWINGS

Below, the invention will be described with reference to Figures that only show exemplary embodiments of the invention. In the Figures, the following is shown.

In the drawings.

DETAILED DESCRIPTION OF PREFERRED EMBODIMENTS

Figure 1:
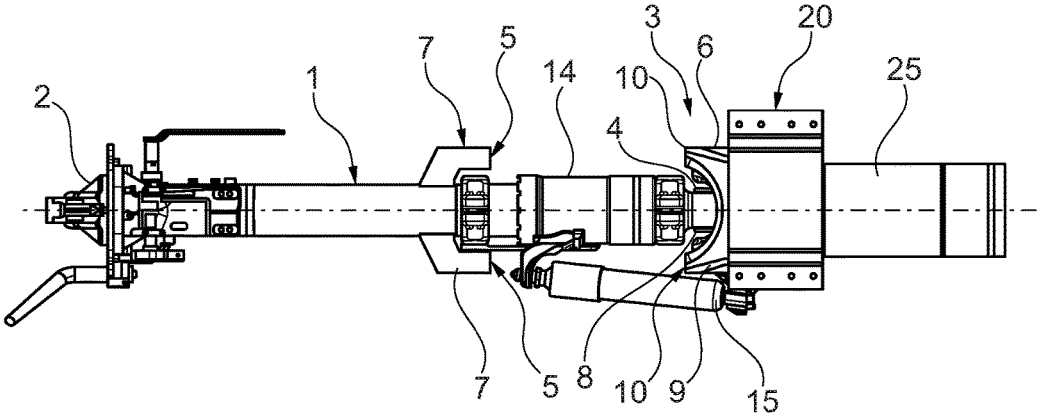
FIG. 1 is a side view of a system according to the invention in a normal travelling condition.

FIG. 1 shows the system according to the invention. The system has a coupler rod 1 and a coupler head 2 attached to one end of the coupler rod 1. The system also has a bearing bracket 3 suitable to connect the connection rod 1 to a car of a multi-car vehicle, for example a car of a train.

The bearing bracket 3 has an adapter 4 that is part of the coupler rod 1. The bearing bracket 3 also has a bracket 20 suitable for being connected to the car and a joint 6 arranged in such manner it allows the adapter 4 to swivel relative to the bracket 20 about at least one swivel axis, namely the vertical axis.

The coupler rod 1 has two horizontal surfaces 5 that each extends in a direction (lie in a plane) that is not parallel to the longitudinal axis of the coupler rod 1. The horizontal surfaces 5 are each arranged on a stabilizing element 7 that is attached to the further parts of the coupler rod 1, namely to the outer surface of a cylindrical section of the coupler rod 1.

Figure 2:
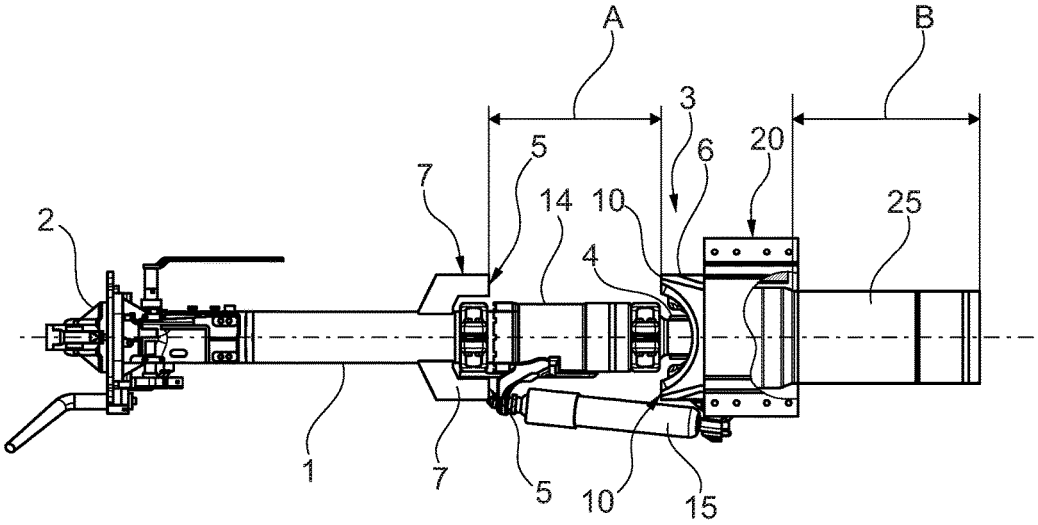
FIG. 2 is a side view of a system according to the invention in a normal travelling condition with a pushing force below the predetermined first strength being applied to the coupler rod.

In the normal driving conditions shown in FIGS. 1 and 2, the two horizontal surfaces 5 are arranged spaced apart from respective horizontal surfaces 10 of the bearing bracket 3.

The joint 6 has a joint pin 8 held in a receptacle of a joint receiving part of the joint 6. The joint receiving part is connected to the bracket 20.

The system furthermore has a deformation tube 25 as energy absorbing element. As can be best seen by the partial cut-out provided in FIG. 2, the deformation tube 25 reaches into a central opening of the bracket 20. In this central opening of the bracket 20, the front end of the coupling rod 1 is in contact with the front end of the deformation tube 25. The front end of the coupling rod 1 has the shape of a cone (see FIGS. 4 and 5) that is in contact with a conical lateral contraction of the deformation tube.

The coupler rod 1 has a hydraulic cylinder 14 as damping element. As can be seen by comparing FIG. 1 and FIG. 2, the left part of the coupler rod 1 ends in a piston rod that is inserted into the cylinder of the hydraulic cylinder. In FIG. 2 the piston rod has moved further into the cylinder because of a pushing force being applied from the left hand side onto the coupler head, for example if the train is travelling from right to left and is braking.

The coupler rod 1 is supported by two additional hydraulic cylinders 15 that provide an alignment function, namely to align the coupling rod 1 into a specific horizontal position and to return the coupling rod 1 to this horizontal position, if the coupling rod 1 has swivelled to the left or to the right in the horizontal plane (the horizontal plane being the plane that is perpendicular to the paper and that contains the longitudinal axis of the coupler rod 1).

Figure 3:
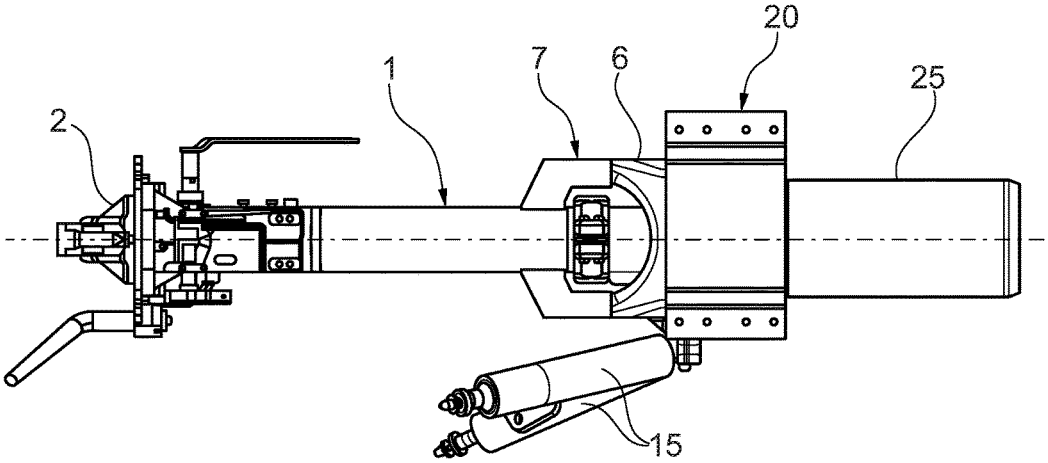
FIG. 3 is a side view of a system according to the invention in a crash scenario with a pushing force above the predetermined first strength, but below the predetermined second strength being applied to the coupler rod.

FIG. 3 shows an operational condition, in which a pushing force of a predetermined first strength has been applied to the coupler rod 1 acting along the longitudinal axis of the coupler rod from left to right. This force has led to the deformation tube 25 being activated. The cone shaped front end of the coupler rod 1 has been pushed into the deformation tube 25 thereby widening the diameter of the deformation tub 25 and thereby absorbing energy. In FIG. 3 the cone shaped front end of the coupler rod 1 can be seen protruding out of the right hand side of the deformation tube 25.

FIG. 3 also shows that the surfaces 5 of the coupler rod 1 have moves in the direction of the bracket 20 to come into contact with the surface 10 of the bearing bracket. This contact of the stabilizing element 7 with the bracket 20 limits the further movement of the coupler rod 1 towards the right. A pushing force that still might be acting along the longitudinal axis of the coupler rod 1 is introduced via the stabilizing element 7 into the bracket 20. The pushing force will those not be transmitted through the joint 6 and the hydraulic cylinder 14 anymore. This helps to prevent destruction of the joint 6 and/or the hydraulic cylinder 14.

FIG. 2 shows that once the axial movement of the piston rod of the hydraulic cylinder 14 integrated into the coupling rod 1 has been fully used up (as is shown in FIG. 2), the stabilizing element 7 has a stroke A. The deformation tube 25 has an active stroke B, in which the deformation tube can absorb energy. In the embodiment shown in the FIGS. 1 to 5, the stroke A and the stroke B have synchronized in such a manner that the stroke A is used up substantially at the same time as the stroke B is used up (and the cone shaped front end of the coupler rod 1 leaves the right hand end of the deformation tube 25).

FIG. 3 also shows that the connection of the additional hydraulic cylinders 15 to the coupler rod 1 has broken away.

Figure 4:
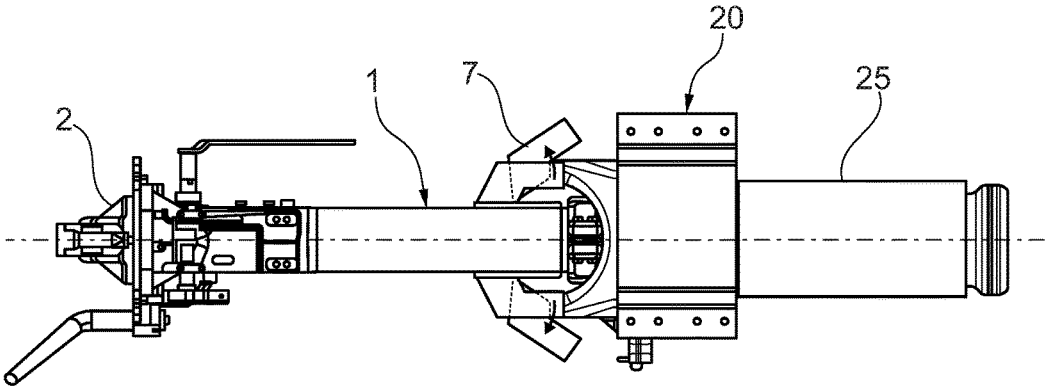
FIG. 4 is a side view of a system according to the invention in a crash scenario with a pushing force above the predetermined second strength being applied to the coupler rod and FIG. 5 is a side view of a system according to the invention in a crash scenario with the pushing force above the predetermined second strength still being applied to the coupler rod.
Figure 5:
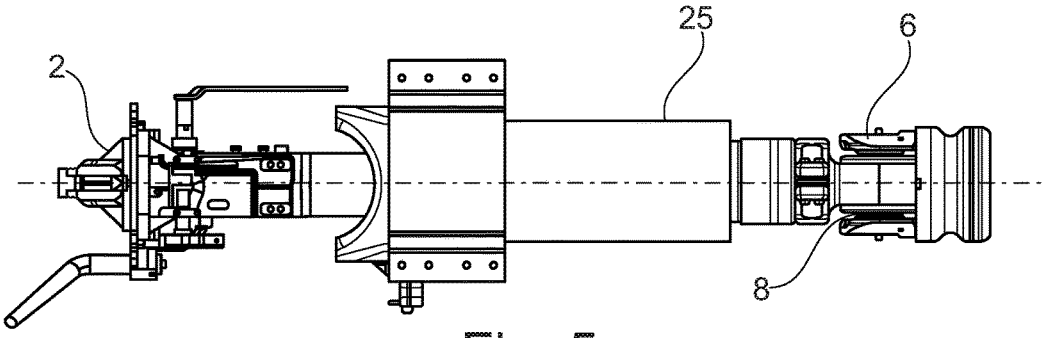

FIG. 4 shows the operational condition, in which a pushing force of a predetermined second strength is applied along the longitudinal axis of the coupler rod 1 from the left. The pushing force of a predetermined second strength is larger than the pushing force of the predetermined first strength. The application of the pushing force of the predetermined second strength leads to the further parts of the coupler rod or connection rod to move relative to the stabilizing element 7, namely by the stabilizing element braking way from the cylindrical part of the coupler rod 1 that it is connected to. This sets the coupler rod 1 free to move again (as seen in FIG. 5). This allows for additional crash absorbers (not shown), like anticlimbers or crash side absorbers to be activated.

FIG. 5 shows, how the cone shaped front end of the joint 6 has protruded fully from the right hand end of the deformation tube 25.

The invention claimed is:

1. A coupling system for multi-car vehicles, comprising:

a bearing bracket defining a surface and comprising:

a bracket suitable for being connected to a car of a multi-car vehicle, and a joint connected to the bracket;

an adapter connected to the joint, the joint allowing the adapter to swivel relative to the bracket about at least one swivel axis, the adapter configured to be set free to move relative to the bearing bracket in at least one direction in response to a pushing force of a predetermined first strength applied to the adapter in the at least one direction; and a rod, the rod being at least one of a coupler rod or a connection rod having a longitudinal axis and connected to the bearing bracket, the rod comprising a stabilizing element attached thereto having at least one surface that extends in a direction that is not parallel to the longitudinal axis of the rod and arranged spaced apart from the surface of the bearing bracket in a normal traveling condition, wherein the stabilizing element is configured to, once the adapter is free to move relative to the bearing bracket in the at least one direction, move in the at least one direction until the surface of the stabilizing element comes into contact with the surface of the bearing bracket, and wherein the stabilizing element is further configured to detach from the rod in response to a pushing force of a predetermined second strength, higher than the predetermined first strength, applied to the rod along the longitudinal axis of the rod in the operating condition where the surface of the stabilizing element is in contact with the surface of the bearing bracket.

2. System according to claim 1, wherein the pushing force of the predetermined second strength is at least 10% higher than the pushing force of the predetermined first strength.

3. System according to claim 1, wherein the stabilizing element is connected to the rod by way of at least one of shear off bolts, shear off pins or a frictional connection.

4. System according to claim 1, wherein the stabilizing element is attached to the rod via at least one of a welded or glued attachment.

5. System according to claim 1, wherein the stabilizing element is a unitary piece with the rod, with a material weakness that lets the stabilizing element break away from the rod, if the pushing force of the predetermined second strength is applied to the rod along the longitudinal axis of the rod in the operating condition where the surface of the stabilizing element is in contact with the surface of the bearing bracket.

6. System according to claim 1, wherein the joint has at least one joint pin that is received in a receptacle of a joint receiving part, and wherein:

the adapter is configured to be set free to move relative to the joint pin, if a pushing force of the predetermined first strength is applied to the adapter in the at least one direction.

7. System according to claim 1, wherein the joint has at least one joint pin that is received in a receptacle of a joint receiving part, and wherein:

the joint pin is configured to be set free to move relative to the joint receiving part, if a pushing force of the predetermined first strength is applied to the adapter in the at least one direction.

8. System according to claim 1, wherein the joint has at least one joint pin that is received in a receptacle of a joint receiving part, and wherein:

the joint receiving part is configured to be set free to move relative to the bracket, if a pushing force of the predetermined first strength is applied to the adapter in the at least one direction.

9. System according to claim 1, wherein the surface of the stabilizing element is arranged at least one of: (a) above a horizontal plane that contains the longitudinal axis of the rod, (b) below the horizontal plane that contains the longitudinal axis of the rod, (c) left of a vertical plane that contains the longitudinal axis of the rod or (d) right of the vertical plane that contains the longitudinal axis of the rod.

10. System according to claim 1, wherein the rod comprises at least one of a rubber draft gear or a destructive energy absorbing element.

11. System according to claim 1, wherein:

the rod has a front end;

an energy absorbing element is at least one of arranged in contact with the front end or spaced apart from the front end; and the energy absorbing element is configured to be deformed to absorb energy by a movement of the front end that is caused by the adapter being set free to move relative to the bracket in the at least one direction, if a pushing force of a predetermined strength is applied to the adapter in the at least one direction.

12. A multi-car vehicle, comprising:

a first car;

a second car; and a connection between and connecting the first car and the second car, the connection comprising:

a bearing bracket, having a surface, and comprising:

a bracket suitable for being connected to a car of a multi-car vehicle, and a joint connected to the bracket;

an adapter connected to the joint, the joint allowing the adapter to swivel relative to the bracket about at least one swivel axis, the adapter configured to be set free to move relative to the bearing bracket in at least one direction, in response to a pushing force of a predetermined first strength applied to the adapter in the at least one direction; and a rod, the rod being at least one of a coupler rod or a connection rod, having a longitudinal axis, connected to the bearing bracket, the rod comprising a stabilizing element attached thereto; the stabilizing element having at least one surface that extends in a direction that is not parallel to the longitudinal axis of the rod and arranged spaced apart from the surface of the bearing bracket in a normal traveling condition, wherein the stabilizing element is configured to, once the adapter is free to move relative to the bearing bracket in the at least one direction, move in the at least one direction until the surface of the stabilizing element comes into contact with the surface of the bearing bracket, and wherein the stabilizing element is further configured to detach from the rod in response to a pushing force of a predetermined second strength, higher than the predetermined first strength, applied to the rod along the longitudinal axis of the rod in the operating condition where the surface of the stabilizing element is in contact with the surface of the bearing bracket.

13. The multi-car vehicle of claim 12, wherein the adapter is an end section of the rod.

14. The multi-car vehicle of claim 12, wherein the adapter is separate from the rod.

15. Method for providing multi-stage energy absorption in a connector between two cars in a multi-car vehicle, comprising:

in a normal traveling condition, connecting two cars of a multi-car vehicle by a system including:

a bearing bracket defining a surface and comprising:

a bracket connected to one of the cars, and a joint connected to the bracket;

an adapter connected to the joint, the joint allowing the adapter to swivel relative to the bracket about at least one swivel axis, and a rod, the rod being at least one of a coupler rod or a connection rod, having a longitudinal axis and connected to the bearing bracket, the rod comprising a stabilizing element attached thereto having at least one surface that extends in a direction that is not parallel to the longitudinal axis of the rod and arranged spaced apart from the surface of the bearing bracket in the normal traveling condition;

responsive to a pushing force of a predetermined first strength being applied to the adapter in at least one direction, setting the adapter free to move relative to the bearing bracket in the at least one direction, permitting the stabilizing element to move in the at least one direction until the surface of the stabilizing element comes into contact with the surface of the bearing bracket; and responsive to a pushing force of a predetermined second strength, higher than the predetermined first strength, applied to the rod along the longitudinal axis of the rod in the operating condition where the surface of the stabilizing element is in contact with the surface of the bearing bracket, the stabilizing element separating from the rod and the rod moving relative to the stabilizing element.

16. The method of claim 15, wherein the pushing force of the predetermined second strength is at least 10% higher than the pushing force of the predetermined first strength.

17. The method of claim 16, wherein the pushing force of the predetermined second strength is at least 20% higher than, and not more than 40% higher than, the pushing force of the predetermined first strength.

* * * * *